US010060446B2

(12) United States Patent
Xing et al.

(10) Patent No.: US 10,060,446 B2
(45) Date of Patent: Aug. 28, 2018

(54) COOLING OR HEATING FLUID CIRCULATION SYSTEM OF A DOUBLE-SUPPORTED CENTRIFUGAL PUMP

(71) Applicant: Tianyi Xing, Tianjin (CN)

(72) Inventors: Yu Xing, Tianjin (CN); Tianyi Xing, Tianjin (CN)

(73) Assignee: Tianyi Xing, Tianjin (CN)

( * ) Notice: Subject to any disclaimer, the term of this patent is extended or adjusted under 35 U.S.C. 154(b) by 0 days.

(21) Appl. No.: 15/519,257

(22) PCT Filed: Aug. 27, 2015

(86) PCT No.: PCT/CN2015/088223
§ 371 (c)(1),
(2) Date: Apr. 14, 2017

(87) PCT Pub. No.: WO2016/058451
PCT Pub. Date: Apr. 21, 2016

(65) Prior Publication Data

US 2017/0241437 A1 Aug. 24, 2017

(30) Foreign Application Priority Data

Oct. 17, 2014 (CN) ..... 2014 1 0448893
Mar. 31, 2015 (CN) ..... 2015 1 0148563

(51) Int. Cl.
*F04D 29/08* (2006.01)
*F04D 29/58* (2006.01)
(Continued)

(52) U.S. Cl.
CPC ..... *F04D 29/588* (2013.01); *F04D 29/043* (2013.01); *F04D 29/10* (2013.01)

(58) Field of Classification Search
CPC ..... F04D 29/588; F04D 29/5886; F04D 29/5893; F04D 29/10; F04D 29/043;
(Continued)

(56) References Cited

U.S. PATENT DOCUMENTS 2,632,395 A * 3/1953 Jennings ..... F04D 29/108 165/134.1
3,318,253 A * 5/1967 Campolong ..... F04D 13/0613 165/104.31
3,976,391 A 8/1976 Randell

FOREIGN PATENT DOCUMENTS

CN 1400397 A 3/2003
CN 201196166 Y 2/2009
(Continued)

*Primary Examiner* — Jason Shanske
*Assistant Examiner* — Jason Mikus
(74) *Attorney, Agent, or Firm* — George G. Wang; Bei & Ocean

(57) ABSTRACT

A cooling or heating fluid circulation system of the double-supported centrifugal pump, comprises a left shaft sleeve and a right shaft sleeve which are sleeved on the periphery of the pump shaft, a first left sealing gland and a second left sealing gland are sleeved on the periphery of the left shaft sleeve via a left outside stationary sealing ring, a left outside rotating sealing ring and a left inside stationary sealing ring respectively, a first right sealing gland and a second right sealing gland are sleeved on the periphery of the right shaft sleeve via a right outside stationary sealing ring, a right outside rotating sealing ring and a right inside stationary sealing ring respectively; a heat exchange fluid circulation channel, which is formed among the first left sealing gland, the second left sealing gland, the left shaft sleeve, the pump shaft, the right shaft sleeve, the first right sealing gland and the second right sealing gland, is connected with an external heat exchanger via an external channel; the heat exchange fluid therein is capable of rotating simultaneously with the
(Continued)

rotating part and flowing along the axial direction of rotating part. The present invention is capable of directly cooling or heating the rotating parts which are most in need of cooling or heating, thus the temperature of the rotating parts can be kept in a certain range.

5 Claims, 7 Drawing Sheets

(51) Int. Cl.
*F04D 29/043* (2006.01)
*F04D 29/10* (2006.01)

(58) Field of Classification Search
CPC ..... F04D 29/124; F04D 29/128; F04D 29/58; F04D 29/5806; F04D 29/5826; F04D 29/584
USPC ..... 415/112
See application file for complete search history.

(56) References Cited

FOREIGN PATENT DOCUMENTS

| | | | |
|---|---|---|---|
| CN | 101532500 | A | 9/2009 |
| CN | 201535254 | U | 7/2010 |
| CN | 202118002 | U | 1/2012 |
| CN | 102536842 | A | 7/2012 |
| CN | 203362629 | U | 12/2013 |
| CN | 104235073 | A | 12/2014 |
| CN | 204591809 | U | 8/2015 |
| DE | 2233381 | C | 1/1974 |
| EP | 0290752 | U | 3/1988 |

* cited by examiner

COOLING OR HEATING FLUID CIRCULATION SYSTEM OF A DOUBLE-SUPPORTED CENTRIFUGAL PUMP

FIELD OF THE INVENTION

The invention relates to a double-supported centrifugal pump, particularly to a cooling or heating fluid circulation system of a double-supported centrifugal pump.

BACKGROUND OF THE INVENTION

In the oil refining and chemical industry, high temperature centrifugal pumps play an important role in rotating machines, and its cooling or heating is still the focus of attention in this field.

Most of the methods so far have been for cooling the stationary parts of the centrifugal pump, such as bearing housing, mechanical sealing gland, etc., which are shown in the Chapter "Cooling Water and Lubrication System" of API610 Appendix B (Standard) and the Chapter "Standard Flushing Solution and Standard Seal Flush Solution 02 in Auxiliary Metal Components" of API682 Appendix D (Standard Appendix); and the methods for the cooling of the rotating parts are also limited to the partial surface, as described in the Chapter "Standard Flushing Solution and Standard Seal Flush Solution in Auxiliary Metal Components 51, 61, 65A, 65B, 66A, 66B and 52, 53A, 53B, 53C, 54, 55" of API 682 Appendix D (Standard Appendix). Furthermore, the cooling fluid neither can rotate simultaneously together with the rotating part nor can flow along the axial direction after the cooling fluid is in contact with partial rotating part, and flow area is small. As shown in FIG. 1 and FIG. 2, two cooling channels, which are not communicated with each other, are formed on the sealing glands 3, 5 of each side of the double-supported centrifugal pump, i.e., cooling or heating fluid can only be circulated in the respective channel located on the sealing glands 3, 5 of each side of the double-supported centrifugal pump, whereas the pump shaft 1 can not be cooled or heated.

In addition, the methods of cooling the stationary component of the centrifugal pump body in the exemplary embodiment is: introduce low temperature circulating fluid, e.g., water, oil, steam or nitrogen, into the pump chamber, bearing box and the hollow cavity of mechanical sealing gland; the fluid flows through the high-temperature parts and then flows out with the heat, and the output fluid becomes a high-temperature fluid, and then the fluid flows through the stationary cooler arranged outside the pump for cooling down the temperature, and then reintroduces the low-temperature fluid into the stationary components of pump for circulation, and thus achieves the purpose of controlling the temperature of the pump. This method is called cooling.

Similarly, when the pump needs to be heated, it is required to replace the cooler in the above-mentioned cooling method with heater to achieve a heating method. Heating in this way is called heating.

Until now, there is not such technology can introduce the fluid directly into the hollow cavity of rotating parts of the high-temperature centrifugal pump for continuous rotation to achieve cooling or heating.

Thus, the deficiencies in prior art for cooling or heating the high temperature centrifugal pumps are:

(A)only performing cooling or heating to the surface of high temperature centrifugal pump rotating parts (such as: shaft or sleeve) has the deficiencies of:

1. The cooling fluid only contacts the partial surface of the rotating parts of the centrifugal pump, i.e., the axial length of fluid contacting the rotating parts is short, so that the overflowing area of cooling fluid is small.
2. The portion of the rotating part cooled or heated by the fluid is not the position where most in need of cooling or heating.
3. The fluid can not be axially displaced when it contacts with the surface of the rotating part of the centrifugal pump, so that the convection effect is poor.
4. Targeted cooling cannot be achieved to the whole rotating parts.
5. Direct contacting the cooling fluid with the pump shaft is not achieved.

(B) Only performing cooling or heating to the stationary components of pump body, e.g. pump casing, bearing box and mechanical sealing gland, has the deficiencies of:

1. The stationary components are in contact with the atmosphere, which temperature is not same as the core position. Therefore, the true problem of controlling the temperature of core position is not solved yet.
2. The variation of accurate temperature and transient temperature of the core position cannot be accurately measured and monitored.
3. In prior art, there is always a freshly to be transferred feeding material between the components where are cooled or heated and the core components where really need to be cooled or heated, i.e., the feeding material transfers heat to the rotor with a certain time, and the most of the fluid contacted with the rotating parts of the core components of the high temperature centrifugal pump is the freshly to be transferred feeding material. However, these feeding material are simply too late to get cooled or heated to flow away, replaced by new fresh feeding material, and these fresh feeding material are of constant temperature subjecting to refining or chemical process, i.e., the core position of the rotating parts are always not directly cooled or heated according to the existing technology, more like a light dusting.
4. The rotating parts of the high temperature centrifugal pump are the parts that need to be cooled most, keeping them in a high temperature state will bring a lot of unfavorable factors, which are not listed herein.
5. Similarly, the rotating parts of the high temperature centrifugal pump are the parts that need to be heated most, leaving them without adequate heating will bring a serious result, especially in the startup time, which are not too much mentioned herein.

SUMMARY OF THE INVENTION

The problem to be solved in the present invention is to provide a cooling or heating fluid circulation system of a double-supported centrifugal pump capable of directly cooling or heating the rotating parts which are most in need of cooling or heating.

The technical scheme of the invention is as follows: a cooling or heating fluid circulation system of a double-supported centrifugal pump, which is formed inside the double-supported centrifugal pump, comprises a pump shaft, a left shaft sleeve and a right shaft sleeve which are sleeved on the periphery of the pump shaft, a first left sealing gland and a second left sealing gland which are sleeved on the periphery of the left shaft sleeve via a left outside stationary sealing ring, a left outside rotating sealing ring and a left inside stationary sealing ring respectively, a first right sealing gland and a second right sealing gland which are sleeved on the periphery of the right shaft sleeve via a right outside stationary sealing ring, a right outside rotating sealing ring and a right inside stationary sealing ring respectively; a heat exchange fluid circulation channel, which is formed among the first left sealing gland, the second left sealing gland, the left shaft sleeve, the pump shaft, the right shaft sleeve, the first right sealing gland and the second right sealing gland, is connected with an external heat exchanger via an external channel; the heat exchange fluid therein is capable of rotating simultaneously with the rotating parts and flowing along the axial direction of rotating parts.

The heat exchange fluid circulation channel comprises the following channels communicated in sequence: a first channel formed on the first left sealing gland, an upper end opening of which is connected with the heat exchanger via the external channel; a second channel, which is formed between the first left sealing gland and the left outside rotating sealing ring, passes through the left pumping ring; a third channel which is formed among the second left sealing gland, the left outside rotating sealing ring, the left inside stationary sealing ring and the left shaft sleeve; an eighth channel which is formed on the left shaft sleeve and the pump shaft; a fourth channel formed inside the pump shaft; a ninth channel which is formed on the right shaft sleeve and the pump shaft; a fifth channel which is formed among the right shaft sleeve, the right inside stationary sealing ring, the second right sealing gland and the right outside rotating sealing ring; a sixth channel, which is formed between the first right sealing gland and the right outside rotating sealing ring, passes through the right pumping ring; and the seventh channel formed on the first right sealing gland, an upper end opening of which is connected with the heat exchanger via the external channel.

Wherein the second channel formed between the first left sealing gland and the left outside rotating sealing ring is arranged with a left pumping ring, the sixth channel formed between the first right sealing gland and the right outside rotating sealing ring is arranged with a right pumping ring.

The fourth channel is formed inside the pump shaft and along the axial direction of pump shaft.

In another exemplary embodiment, the heat exchange fluid circulation channel comprises the following channels communicated in sequence: the first channel formed on the first left sealing gland, an upper end opening of which is connected with the heat exchanger via the external channel; a second channel, which is formed between the first left sealing gland and the left outside rotating sealing ring, passes through the left pumping ring; a third channel which is formed among the second left sealing gland, the left outside rotating sealing ring, the left inside stationary sealing ring and the left shaft sleeve; an eighth channel which is formed on the left shaft sleeve; a fourth channel formed among the inner surface of left shaft sleeve and right shaft sleeve and the outside surface of pump shaft; a ninth channel which is formed on the right shaft sleeve; a fifth channel which is formed among the right shaft sleeve, the right inside stationary sealing ring, the second right sealing gland and the right outside rotating sealing ring; a sixth channel, which is formed between the first right sealing gland and the right outside rotating sealing ring, passes through the right pumping ring; and the seventh channel formed on the first right sealing gland, an upper end opening of which is connected with the heat exchanger via the external channel.

Wherein the second channel formed between the first left sealing gland and the left outside rotating sealing ring is arranged with a left pumping ring, the sixth channel formed between the first right sealing gland and the right outside rotating sealing ring is arranged with a right pumping ring.

The fourth channel is formed outside the pump shaft and along the axial direction of pump shaft.

The cooling or heating fluid circulation system of a double-supported centrifugal pump is capable of directly cooling or heating the rotating parts which are most in need of cooling or heating, i.e., providing cooling or heating to the rotating parts of the high temperature centrifugal pump, and keeping the temperature of the rotating parts within a certain range. The present invention has the advantages of:

1. overcoming the deficiencies of the prior art;
2. achieve controlling the temperature of rotating parts of the centrifugal pump instead of passive controlling;
   a. for achieving the purpose of cooling or heating the most needed position along the axial direction of the rotating parts, it is designed to arrange the channels at where most in need of cooling or heating, so that the cooling or heating fluid can pass through there;
   b. actively increasing or decreasing the flow of the cooling or heating fluid;
3. by measuring the instant fluid temperature when the fluid flowed from the rotating cavity of the rotating parts of the centrifugal pump, the accurate and instant temperature of the core position of the rotating parts can be controlled. Since we could know the possible problems earlier and more accurately, the pump shall operate safe and sound by taking steps earlier;
4. without too much increase of matter input and donot confict with the standards API610 and API682, the present invention is capable of parallel use with the solutions 52, 53A, 53B, 53C, 54, 55, and all the equipment and solutions having double-surface mechanical sealing or two throttle mechanism;
5. realizing effective temperature control to the rotating parts where most in need of temperature control;
6. broadening the development space for the high temperature centrifugal pump industry, even for oil refining and chemical industry. Since developing deep processing of oil refining and chemical industry is a general trend, and less chemical residues produces higher operating temperature, it requires a certain way to control the pump temperature for developing the industry;
7. adapting to the rotating rotor of chemical reactors and other equipment with rotor and stator, such as: turbines, compressors, fans, motors, generators, engines, combustion engines, screw pumps, gear pumps, etc.

Figure 1:
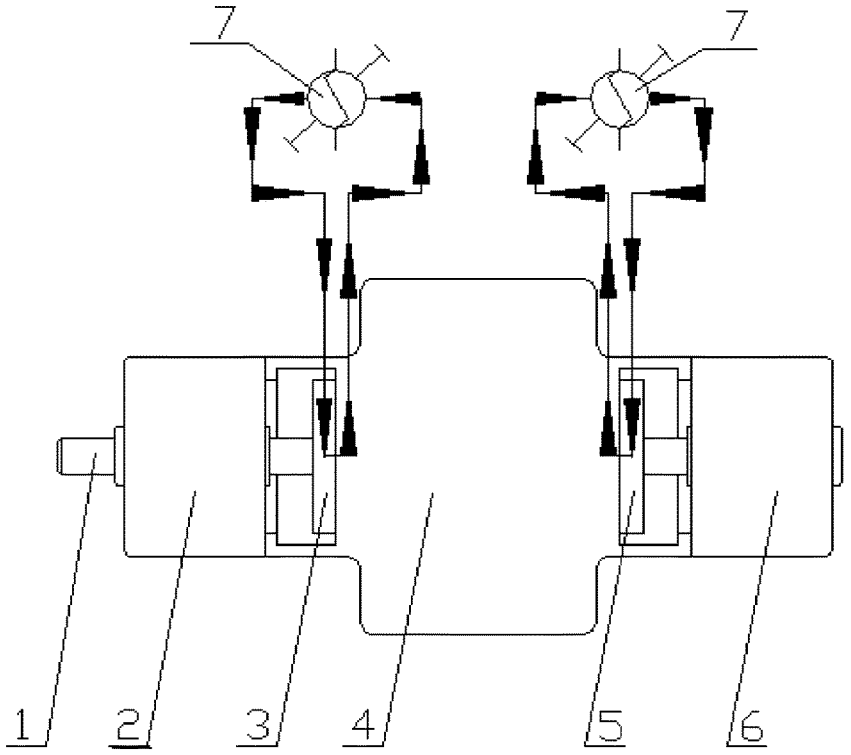
FIG. 1 shows an external structural diagram of a double-supported centrifugal pump of the prior art.
Figure 2:
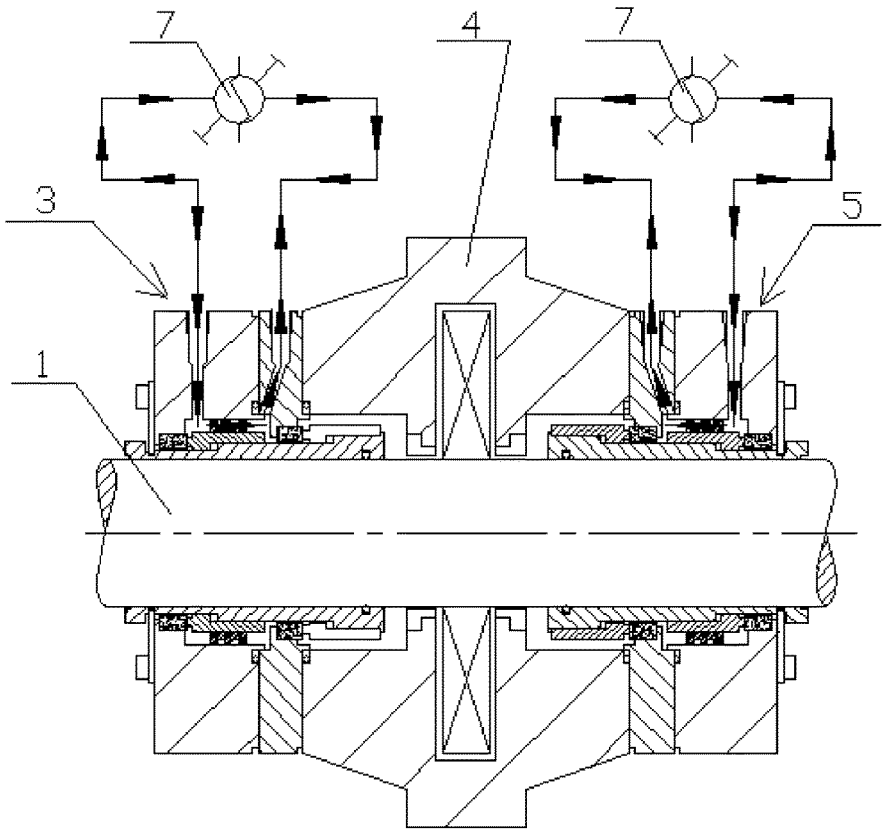
FIG. 2 shows an inner structural diagram of a double-supported centrifugal pump of the prior art.

Wherein:

1 pump shaft 2 left bearing seat
3 left sealing gland 4 pump casing
5 right sealing gland 6 right bearing seat
7 heat exchanger 8 external channel
9 left pumping ring 10 left outside rotating sealing ring
11 left inside stationary sealing ring 12 right outside rotating sealing ring
13 right inside stationary sealing ring 14 right pumping ring
15 vane wheel 16 left outside stationary sealing ring
17 left inside rotating sealing ring 18 right outside stationary sealing ring
19 right inside rotating sealing ring 21 left shaft sleeve
22 right shaft sleeve 31 first left sealing gland
32 second left sealing gland 51 first right sealing gland
52 second right sealing gland 201 first channel
202 second channel 203 third channel
204 fourth channel 205 fifth channel
206 sixth channel 207 seventh channel
208 eighth channel 209 ninth channel
301 first channel 302 second channel
303 third channel 304 fourth channel
305 fifth channel 306 sixth channel
307 seventh channel 308 eighth channel
309 ninth channel

DETAILED DESCRIPTION OF THE EMBODIMENTS

The cooling or heating fluid circulation system of a double-supported centrifugal pump of the present invention will be described in detail with reference to the embodiments and the accompanying drawings.

The cooling or heating fluid circulation system of a double-supported centrifugal pump is capable of directly providing cooling or heating fluid to the rotating parts of the high-temperature centrifugal pump which is most in need of cooling or heating. The technical scheme is as follows: by the mechanical sealing or throttle mechanism, a circulating fluid with initial temperature flows from external into the rotating part via the stationary component of the pump, the fluid is capable of rotating simultaneously with the rotating part and flowing along the axial direction of the rotating part to the core position where most in need of cooling or heating. After performing sufficient heat exchange, fluid continuously flows out of the rotating part and takes the heat away from the rotating part, and the fluid passes from the inner pump to the external channel for heat exchange outside the pump, and the temperature returns to the initial temperature, and then the cooled fluid flows into the rotating part of the pump for circulation again, and the heat exchange continuous with the circulation to achieve the purpose of controlling the temperature of rotating parts of the centrifugal pump.

Figure 3:
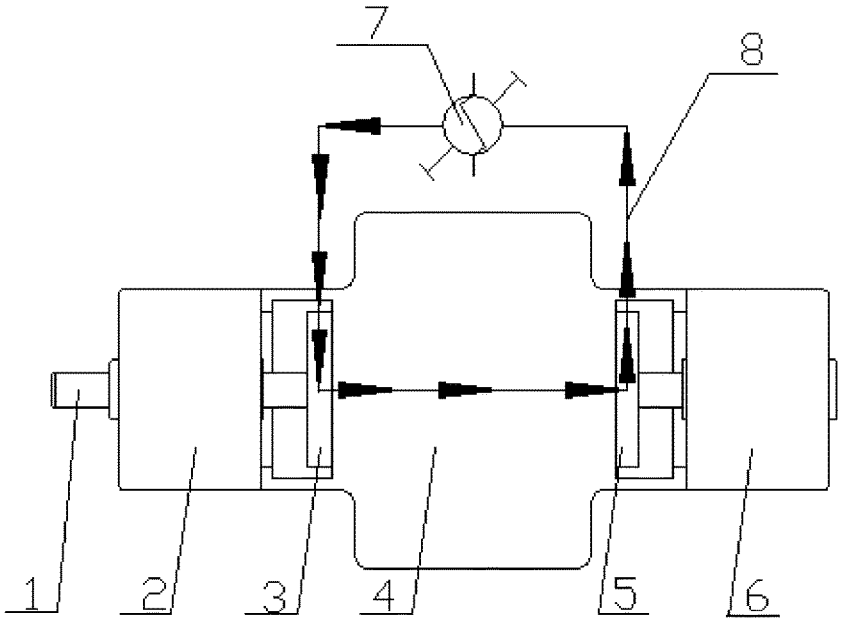
FIG. 3 shows an external structural diagram of the first embodiment of double-supported centrifugal pump of the present invention.
Figure 4:
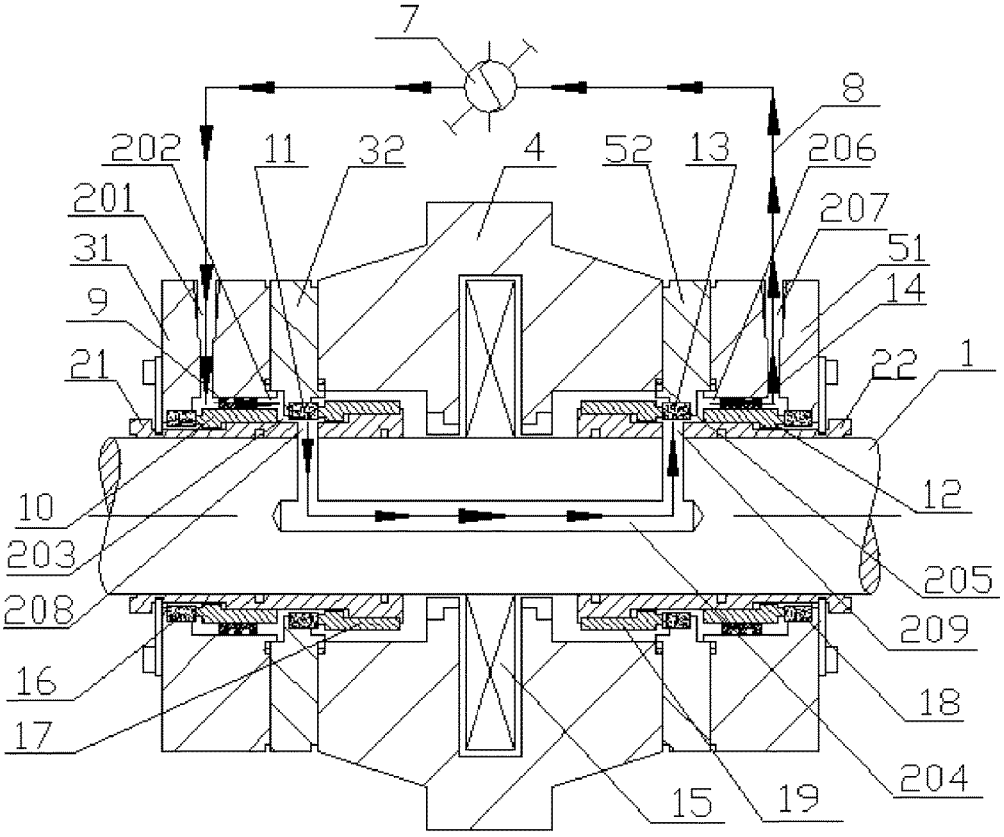
FIG. 4 shows an inner structural diagram of the first embodiment of double-supported centrifugal pump of the present invention.

As shown in FIG. 3 and FIG. 4, the cooling fluid circulation system of the double-supported centrifugal pump, which is formed inside the double-supported centrifugal pump, comprises a pump shaft 1, a left shaft sleeve 21 and a right shaft sleeve 22 which are sleeved on the periphery of the pump shaft 1, a first left sealing gland 31 and a second left sealing gland 32 which are sleeved on the periphery of the left shaft sleeve 21 via a left outside stationary sealing ring 16, a left outside rotating sealing ring 10 and a left inside stationary sealing ring 11 respectively, a first right sealing gland 51 and a second right sealing gland 52 which are sleeved on the periphery of the right shaft sleeve 22 via a right outside stationary sealing ring 18, a right outside rotating sealing ring 12 and a right inside stationary sealing ring 13 respectively; a heat exchange fluid circulation channel, which is formed among the first left sealing gland 31, the second left sealing gland 32, the left shaft sleeve 21, the pump shaft 1, the right shaft sleeve 22, the first right sealing gland 51 and the second right sealing gland 52, is connected with an external heat exchanger 7 via an external channel 8; the heat exchange fluid therein is capable of rotating simultaneously with the rotating parts and flowing along the axial direction of rotating parts.

The heat exchange fluid circulation channel comprises the following channels communicated in sequence as indicated by the arrows in FIG. 3 and FIG. 4: a first channel 201 formed on the first left sealing gland 31, an upper end opening of which is connected with the heat exchanger 7 via the external channel 8; a second channel 202, which is formed between the first left sealing gland 31 and the left outside rotating sealing ring 10, passes through the left pumping ring 9; a third channel 203 which is formed among the second left sealing gland 32, the left outside rotating sealing ring 10, the left inside stationary sealing ring 11 and the left shaft sleeve 21; an eighth channel 208 which is formed on the left shaft sleeve 21 and the pump shaft 1; a fourth channel 204 formed inside the pump shaft 1; a ninth channel 209 which is formed on the right shaft sleeve 22 and the pump shaft 1; a fifth channel 205 which is formed among the right shaft sleeve 22, the right inside stationary sealing ring 13, the second right sealing gland 52 and the right outside rotating sealing ring 12; a sixth channel 206, which is formed between the first right sealing gland 51 and the right outside rotating sealing ring 12, passes through the right pumping ring 14; and the seventh channel 207 formed on the first right sealing gland 51, an upper end opening of which is connected with the heat exchanger 7 via the external channel 8. Wherein, the fourth channel 204 is formed inside the pump shaft 1 and along the axial direction of pump shaft 1.

Wherein the second channel 202 formed between the first left sealing gland 31 and the left outside rotating sealing ring 10 is arranged with a left pumping ring 9, the sixth channel 206 formed between the first right sealing gland 51 and the right outside rotating sealing ring 12 is arranged with a right pumping ring 14.

Figure 5:
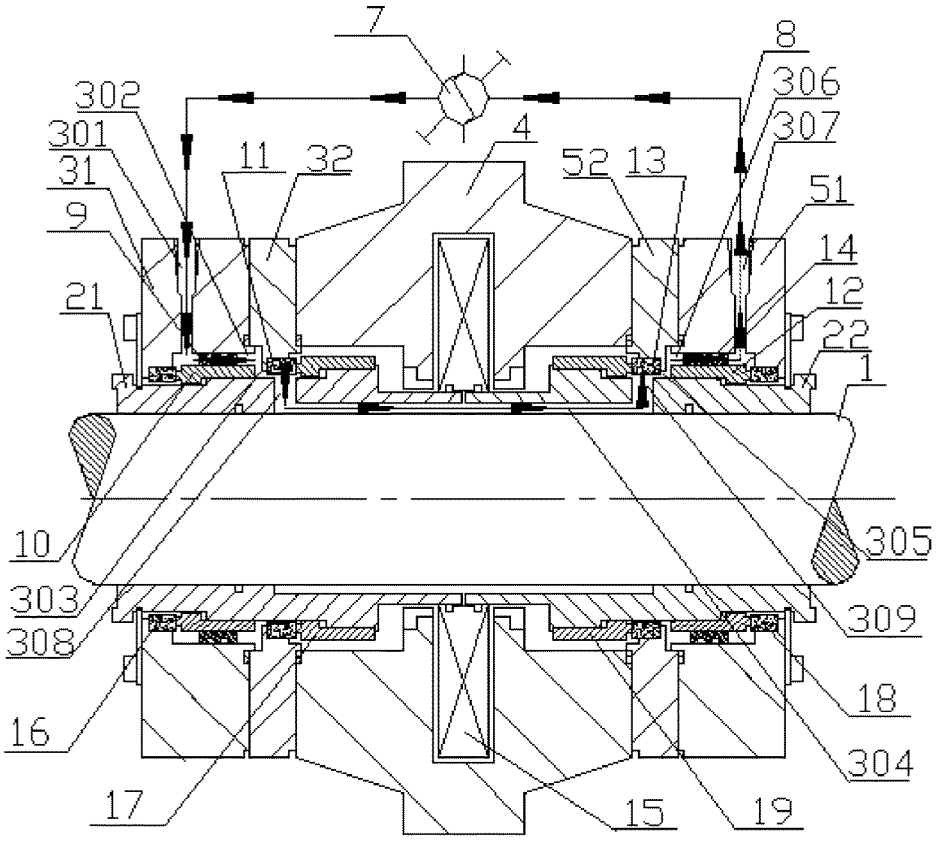
FIG. 5 shows an inner structural diagram of the second embodiment of double-supported centrifugal pump of the present invention.
Figure 6:
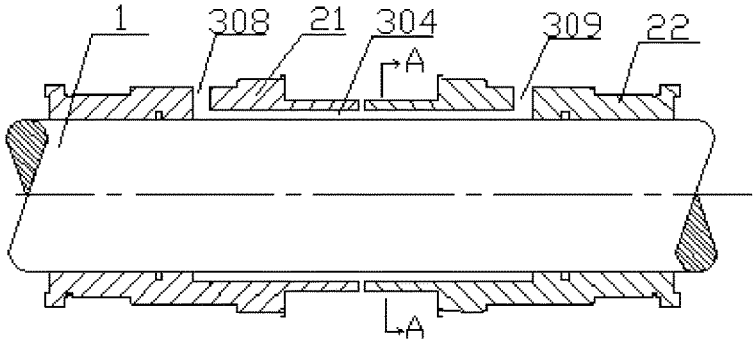
FIG. 6 shows the structural diagram of the pump shaft and shaft sleeve of the second embodiment of double-supported centrifugal pump of the present invention.
Figure 7:
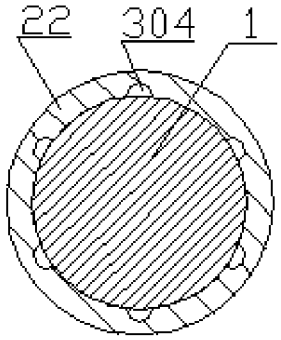
FIG. 7 shows the cross-section view of FIG. 6 along A-A axis.

As shown in FIGS. 5, 6, 7, the heat exchange fluid circulation channel comprises the following channels communicated in sequence as indicated by the arrows in FIG. 5: the first channel 301 formed on the first left sealing gland 31, an upper end opening of which is connected with the heat exchanger 7 via the external channel 8; a second channel 302, which is formed between the first left sealing gland 31 and the left outside rotating sealing ring 10, passes through the left pumping ring 9; a third channel 303 which is formed among the second left sealing gland 32, the left outside rotating sealing ring 10, the left inside stationary sealing ring 11 and the left shaft sleeve 21; an eighth channel 308 which is formed on the left shaft sleeve 21; a fourth channel 304 formed among the inner surface of left shaft sleeve 21 and right shaft sleeve 22 and the outside surface of pump shaft 1; a ninth channel 309 which is formed on the right shaft sleeve 22; a fifth channel 305 which is formed among the right shaft sleeve 22, the right inside stationary sealing ring 13, the second right sealing gland 52 and the right outside rotating sealing ring 12; a sixth channel 306, which is formed between the first right sealing gland 51 and the right outside rotating sealing ring 12, passes through the right pumping ring 14; and the seventh channel 307 formed on the first right sealing gland 51, an upper end opening of which is connected with the heat exchanger 7 via the external channel 8.

Wherein the second channel 302 formed between the first left sealing gland 31 and the left outside rotating sealing ring 10 is arranged with a left pumping ring 9, the sixth channel 306 formed between the first right sealing gland 51 and the right outside rotating sealing ring 12 is arranged with a right pumping ring 14.

The working process of the first embodiment of the cooling fluid circulation system of the double-supported centrifugal pump is as follows:the fluid for heat exchanging inside the double-supported centrifugal pump passes through the heat exchanger 7 via the external channel 8, and passes in sequence of the following communicated channels: a first channel 201 formed on the first left sealing gland 31; a second channel 202, which is formed between the first left sealing gland 31 and the left outside rotating sealing ring 10, passes through the left pumping ring 9; a third channel 203 which is formed among the second left sealing gland 32, the left outside rotating sealing ring 10, the left inside stationary sealing ring 11 and the left shaft sleeve 21; an eighth channel 208 which is formed on the left shaft sleeve 21 and the pump shaft 1; a fourth channel 204 formed inside the pump shaft 1; a ninth channel 209 which is formed on the right shaft sleeve 22 and the pump shaft 1; a fifth channel 205 which is formed among the right shaft sleeve 22, the right inside stationary sealing ring 13, the second right sealing gland 52 and the right outside rotating sealing ring 12; a sixth channel 206, which is formed between the first right sealing gland 51 and the right outside rotating sealing ring 12, passes through the right pumping ring 14; and the seventh channel 207 formed on the first right sealing gland 51. The fluid performs heat exchange with the rotating part inside the double-supported centrifugal pump, in particularly performs heat exchange with the pump shaft 1, and the heat exchanged fluid flows out of the seventh channel 207 and flows into the heat exchanger 7 via the external channel 8 for heat exchange, and the fluid temperature returns back to initial temperature. Then the cooled fluid flows into the first channel 201 again for heat exchange with the rotating part of the pump. This fluid circulation achieves the heat exchange of the rotating part of the double-supported centrifugal pump.

The working process of the second embodiment of the cooling fluid circulation system of the double-supported centrifugal pump as shown in FIG. 5 is similar to the first embodiment thereof as shown in FIG. 3 and FIG. 4. Only one difference in that the fluid for heat exchange with pump shaft 1 in the first embodiment flowing along the axial direction of the pump shaft 1, whereas the fluid for heat exchange with pump shaft 1 in the second embodiment flowing along the axial direction of the gaps constituted by the outer surface of pump shaft 1 and the inner surface of left shaft sleeve 21 and right shaft sleeve 22.

In the whole circulation, restricted by oil refining and chemical process, the temperature of fluid feeding material transmitted by the centrifugal pump is constant, i.e., the feeding material transmits the heat to the rotating part requiring a certain time, the rotating part of the centrifugal pump of the present invention performs a new heat exchange with the cooling liquid flowing through the centrifugal pump when the temperature of the rotating part has not yet changed. Therefore, the temperature of the rotating part can always be controlled within a desired range.

As can be seen in FIG. 4, fluid flows out of the heat exchanger 13 and passes through the first channel 201 for heat exchange with the first left sealing gland 31; passes through the second channel 202 for heat exchange with the first left sealing gland 31, the left outside stationary sealing ring 16, the left outside rotating sealing ring 10, the left pumping ring 9 and the second left sealing gland 32; passes through the third channel 203 for heat exchange with the second left sealing gland 32, the left outside rotating sealing ring 10, the left inside stationary sealing ring 11, left inside rotating sealing ring 17 and the left shaft sleeve 21; passes through the eighth channel 208 for heat exchange with the left shaft sleeve 21, left inside rotating sealing ring 17, left inside stationary sealing ring 11 and the pump shaft 1; passes through the fourth channel 204 for heat exchange with the pump shaft 1; passes through the ninth channel 209 for heat exchange with the pump shaft 1, right shaft sleeve 22, the right inside rotating sealing ring 12 and right inside stationary sealing ring 13; passes through the fifth channel 205 for heat exchange with the right shaft sleeve 22, the right inside rotating sealing ring 19, the right inside stationary sealing ring 13, the right outside rotating sealing ring 12 and the second right sealing gland 52; passes through the sixth channel 206 for heat exchange with the second right sealing gland 52, the right outside rotating sealing ring 12, the right pumping ring 14, the right outside stationary sealing ring 18 and first right sealing gland 51; and passes through the seventh channel 207 for heat exchange with the first right sealing gland 51.

What is claimed is:

1. A cooling or heating fluid circulation system of a double-supported centrifugal pump, which is formed inside the double-supported centrifugal pump, and comprises a pump shaft (1), a left shaft sleeve (21) and a right shaft sleeve (22) which are sleeved on a periphery of the pump shaft (1), a first left sealing gland (31) and a second left sealing gland (32) which are sleeved on a periphery of the left shaft sleeve (21) via a left outside stationary sealing ring (16), a left outside rotating sealing ring (10) and a left inside stationary sealing ring (11) respectively, a first right sealing gland (51) and a second right sealing gland (52) which are sleeved on a periphery of the right shaft sleeve (22) via a right outside stationary sealing ring (18), a right outside rotating sealing ring (12) and a right inside stationary sealing ring (13) respectively; wherein, a heat exchange fluid circulation channel, which is formed among the first left sealing gland (31), the second left sealing gland (32), the left shaft sleeve (21), the pump shaft (1), the right shaft sleeve (22), the first right sealing gland (51) and the second right sealing gland (52), is connected with an external heat exchanger (7) via an external channel (8) so that a heat exchange fluid therein is capable of rotating simultaneously with a rotating part of the pump shaft (1) and flowing along an axial direction of the rotating part; wherein the heat exchange fluid circulation channel comprises the following channels communicated in sequence: a first channel (201) formed on the first left sealing gland (31), an upper end opening of which is connected with the heat exchanger (7) via the external channel (8); a second channel (202), which is formed between the first left sealing gland (31) and the left outside rotating sealing ring (10), and passes through a left pumping ring (9); a third channel (203) which is formed among the second left sealing gland (32), the left outside rotating sealing ring (10), the left inside stationary sealing ring (11) and the left shaft sleeve (21); an eighth channel (208) which is formed on the left shaft sleeve (21) and the pump shaft (1); a fourth channel (204) formed inside the pump shaft (1); a ninth channel (209) which is formed on the right shaft sleeve (22) and the pump shaft (1); a fifth channel (205) which is formed among the right shaft sleeve (22), the right inside stationary sealing ring (13), the second right sealing gland (52) and the right outside rotating sealing ring (12); a sixth channel (206), which is formed between the first right sealing gland (51) and the right outside rotating sealing ring (12), and passes through a right pumping ring (14); and the seventh channel (207) formed on the first right sealing gland (51), an upper end opening of which is connected with the heat exchanger (7) via the external channel (8).

2. The cooling or heating fluid circulation system of the double-supported centrifugal pump according to claim 1, wherein the second channel (202) formed between the first left sealing gland (31) and the left outside rotating sealing ring (10) is arranged with the left pumping ring (9), the sixth channel (206) formed between the first right sealing gland (51) and the right outside rotating sealing ring (12) is arranged with the right pumping ring (14).

3. The cooling or heating fluid circulation system of the double-supported centrifugal pump according to claim 1, wherein the fourth channel (204) is formed inside the pump shaft (1) and along the axial direction of pump shaft (1).

4. A cooling or heating fluid circulation system of a double-supported centrifugal pump, which is formed inside the double-supported centrifugal pump, and comprises a pump shaft (1), a left shaft sleeve (21) and a right shaft sleeve (22) which are sleeved on a periphery of the pump shaft (1), a first left sealing gland (31) and a second left sealing gland (32) which are sleeved on a periphery of the left shaft sleeve (21) via a left outside stationary sealing ring (16), a left outside rotating sealing ring (10) and a left inside stationary sealing ring (11) respectively, a first right sealing gland (51) and a second right sealing gland (52) which are sleeved on a periphery of the right shaft sleeve (22) via a right outside stationary sealing ring (18), a right outside rotating sealing ring (12) and a right inside stationary sealing ring (13) respectively; wherein, a heat exchange fluid circulation channel, which is formed among the first left sealing gland (31), the second left sealing gland (32), the left shaft sleeve (21), the pump shaft (1), the right shaft sleeve (22), the first right sealing gland (51) and the second right sealing gland (52), is connected with an external heat exchanger (7) via an external channel (8) so that a heat exchange fluid therein is capable of rotating simultaneously with a rotating part of the pump shaft (1) and flowing along an axial direction of the rotating part;

wherein the heat exchange fluid circulation channel comprises the following channels communicated in sequence: the first channel (301) formed on the first left sealing gland (31), an upper end opening of which is connected with the heat exchanger (7) via the external channel (8); a second channel (302), which is formed between the first left sealing gland (31) and the left outside rotating sealing ring (10), and passes through the left pumping ring (9); a third channel (303) which is formed among the second left sealing gland (32), the left outside rotating sealing ring (10), the left inside stationary sealing ring (11) and the left shaft sleeve (21); an eighth channel (308) which is formed on the left shaft sleeve (21); a fourth channel (304) formed among the inner surface of left shaft sleeve (21) and right shaft sleeve (22) and the outside surface of pump shaft (1); a ninth channel (309) which is formed on the right shaft sleeve (22); a fifth channel (305) which is formed among the right shaft sleeve (22), the right inside stationary sealing ring (13), the second right sealing gland (52) and the right outside rotating sealing ring (12); a sixth channel (306), which is formed between the first right sealing gland (51) and the right outside rotating sealing ring (12), and passes through the right pumping ring (14); and the seventh channel (307) formed on the first right sealing gland (51), an upper end opening of which is connected with the heat exchanger (7) via the external channel (8).

5. The cooling or heating fluid circulation system of the double-supported centrifugal pump according to claim 4, wherein the second channel (302) formed between the first left sealing gland (31) and the left outside rotating sealing ring (10) is arranged with the left pumping ring (9), the sixth channel (306) formed between the first right sealing gland (51) and the right outside rotating sealing ring (12) is arranged with the right pumping ring (14).

* * * * *